US008360937B2

(12) United States Patent
Liggett

(10) Patent No.: US 8,360,937 B2
(45) Date of Patent: Jan. 29, 2013

(54) ELEVATED ADVENTURE COURSE WITH FALL ARREST SYSTEM

(76) Inventor: James Liggett, Martin, MI (US)

( * ) Notice: Subject to any disclaimer, the term of this patent is extended or adjusted under 35 U.S.C. 154(b) by 0 days.

(21) Appl. No.: 13/184,911

(22) Filed: Jul. 18, 2011

(65) Prior Publication Data

US 2012/0021874 A1 Jan. 26, 2012

Related U.S. Application Data

(63) Continuation of application No. 11/852,738, filed on Sep. 10, 2007, now Pat. No. 7,981,004.

(51) Int. Cl.
*A63B 21/00* (2006.01)

(52) U.S. Cl. ..... 482/35; 482/23

(58) Field of Classification Search ..... 482/35, 482/23; 182/91–94
See application file for complete search history.

(56) References Cited

U.S. PATENT DOCUMENTS 7,175,534 B2 * 2/2007 Liggett ..... 472/15
7,481,741 B1 * 1/2009 Sammann et al. ..... 482/35

* cited by examiner

*Primary Examiner* — Jerome W Donnelly
(74) *Attorney, Agent, or Firm* — Robert J. Sayfie

(57) ABSTRACT

An elevated adventure course, having an ascending entrance-exit tracking member with bases secured downwardly therefrom. The bases oriented leftwardly and rightwardly in alternating fashion to define a non-linear pathway.

8 Claims, 4 Drawing Sheets

ELEVATED ADVENTURE COURSE WITH FALL ARREST SYSTEM

RELATED APPLICATIONS

This application is a continuation of U.S. patent application Ser. No. 11/852,738 filed Sep. 10, 2007 now U.S. Pat. No. 7,981,004 titled ELEVATED ADVENTURE COURSE.

FIELD OF THE INVENTION

This invention relates to an apparatus in which participants are challenged to walk or scale various elements while elevated above the ground, which can test the participant's skills such as confidence or group problem solving.

BACKGROUND OF THE INVENTION

Challenge courses are structures that allow a person or team to challenge themselves by participating in various events such as walking along swinging ropes or planks, at elevated heights. These courses are also used to train military personnel. These courses are also used at recreational parks or other such centers that have go-carts and miniature golf.

The invention is an elevated adventure course, or elevated challenge course that can be placed so as to enable users to traverse above ground and traverse in an arbitrary and varied path.

The challenge courses in the prior art are generally positioned in one general location, and users generally walk up to the set of elements, and traverse along elements arranged next to, perpendicular to, or parallel to the other elements.

There exists a need for an adventure course that can be placed in a park or zoo, or other large area, that enabled viewers to challenge themselves; and also be able to view the grounds below, while being secured by the safety cable of the adventure course or challenge course.

There also exists the need to increase the flow and capacity of participants walking through a park or zoo to allow for increased traffic flow.

There also exists a need to control ascent and descent of people using the course to prevent them from falling, and to prevent falling into others, which may cause others to fall off balance.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 elevated adventure course
20 entrance-exit area
22 second entrance-exit area
30 entrance-exit platform
40 support member
45 top portion
50 tracking member OR ascending entrance-exit member
60 element
70 standing area
80 tracking member OR ascending entrance-exit member
90 vertical member
100 path
210 entrance-exit tracking member OR ascending entrance-exit tracking member
230 bar

240 rope
250 base
260 guide aperture
270 guide
280 entrance-exit support structure
300 non-linear path

SUMMARY OF THE INVENTION

One aspect of the present invention is An elevated adventure course (10), comprising: an ascending entrance-exit tracking member (210), (50), (80); a plurality of bases (250) disposed downwardly from said entrance exit tracking member (210), (50), (80) at a substantially consistent distance; said bases (250) oriented leftwardly and rightwardly in alternating fashion to define a non-linear path (300) of the person using the elevated adventure course (10); and a member (240) securing said base (250) to said entrance-exit tracking member (210), (50), (80).

Another aspect of the present invention is An elevated adventure course (10), comprising: an entrance-exit platform (30) connected to a support member (40); a tracking member (50) secured to a top portion (45) of said support member (40); an element (60) secured to said support member (40); a path (100) defined by a plurality of said elements (60); a second tracking member (80) secured to a top portion (45) of said support member (40); said second tracking member (80) disposed substantially parallel with said tracking member (50); an entrance-exit area (20) having an entrance-exit support structure (280); an entrance-exit tracking member (210) secured at one end to said entrance-exit support structure (280), and secured at another end to said support member (40); a plurality of arms (230) secured to said entrance-exit tracking member (210); a rope (240) extending downwardly from said arm (230); and a base (250) secured to said rope (240); whereby the plurality of ropes (240) define a non-linear pathway (300) that leads to a second entrance-exit area (22).

Another aspect is a method of traversing along an elevated challenge course comprising the steps of: traversing relative to an ascending entrance-exit tracking member (210), (50), (80) connected at one end to an entrance-exit support structure 280, and connected at another end to a support member (40); traversing upon a plurality of bases (250) disposed via a member (240) downwardly from said ascending entrance-exit tracking member (210), (50), (80), said plurality of bases (250) disposed downwardly from said entrance exit tracking member (210), (50), (80) at a substantially consistent distance; said bases (250) oriented leftwardly and rightwardly in alternating fashion to define a non-linear path (300) of the person using the elevated adventure course (10); traversing along said non-linear path (300).

These and other features, aspects and advantages of the present invention will become better understood with reference to the following drawings, description and claims.

DETAILED DESCRIPTION OF THE INVENTION

Figure 1:
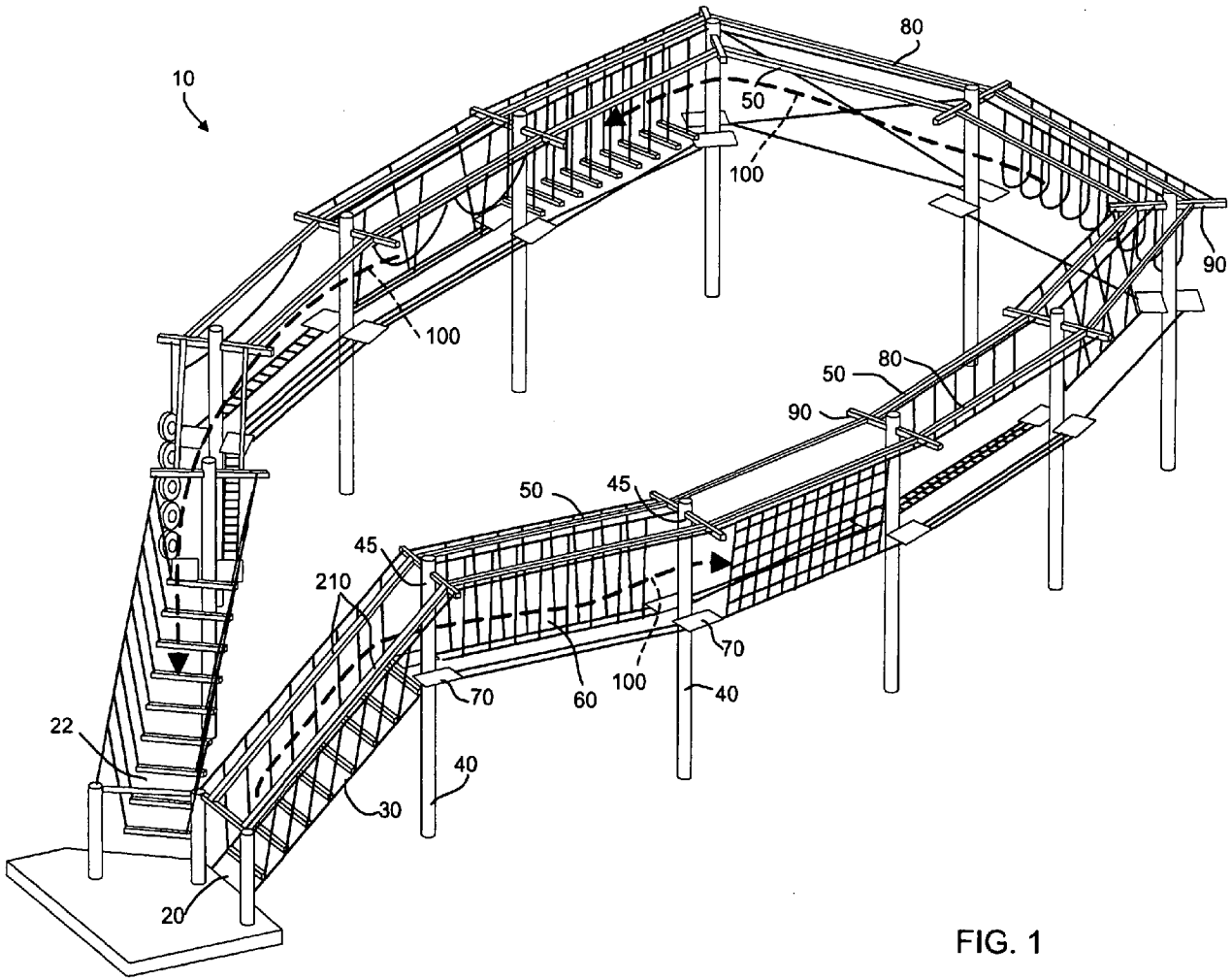
FIG. 1 is a pictorial view of one embodiment of the present invention in its deployed position.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

FIG. 1 illustrates one embodiment of the present invention. The elevated adventure course, which may also be referred to as an elevated challenge course 10 may have an entrance-exit area 20 that leads to a entrance-exit platform 30. In one embodiment the entrance-exit platform 30 may be a ramp. In a further embodiment the entrance-exit platform may be a may be a stairway. The entrance-exit platform 30 may be connected to a support member 40. The support member 40 may extend upwardly from the entrance-exit platform 40 to define a top portion 45.

A tracking member 50, 80 may be secured to the top portion 45. In one embodiment the tracking member 50, 80 may be connected to a vertical member 90. An element 60 may be disposed below the tracking member 50, 80 and the element 60 may be connected to a support member 40. A standing area 70 may be supported by the support member 40.

The vertical member 90 may be secured to the top portion 45.

In one embodiment, several support members 40 are employed to allow participants to walk on several adjacent elements 60 along a path 100 created by the placement of the support members 40 and elements 60.

The tracking member 50 may be the type as disclosed is U.S. Pat. No. 7,416,054, ("the 054 patent"), issued on 26 Aug. 2008; which is described in the abstract as "[a]n apparatus and method of traversing across elements of a challenge course by use of a tracking system that can continuously retain the harness cable that descends to the participant, as the moveable member moves in a substantially horizontal direction along the safety cables, or along the tracks of the moveable member exchange frame."

As illustrated in FIG. 1, the tracking member 50, 80 may be disposed above the elements 60, and other areas that the participant may traverse. The tracking member 50, 80 may movably retain or movably hold a safety cable therein, to secure the participant via cables, belts, or a safety harness, as described in the 960 publication.

Although not illustrated, the tracking member 50, 80 may be disposed above the entrance-exit platform 30 at substantially the same angle as the entrance-exit platform 30. In other words, the tracking member 50 80 may be substantially parallel with the entrance-exit platform 30 so that participant maintains about the same distance from the tracking member 50, 80. This way, the participant may be secured with the tracking member 50, 80 from the ground level, at the point in which they ascend, or descend while on the entrance-exit platform 30.

As illustrated in FIG. 1, two tracking members 50, 80 are illustrated. This enables participants to traverse in one direction along, for example, tracking member 50, while other participants may traverse in the opposite direction along an element via tracking member 80.

Figure 2:
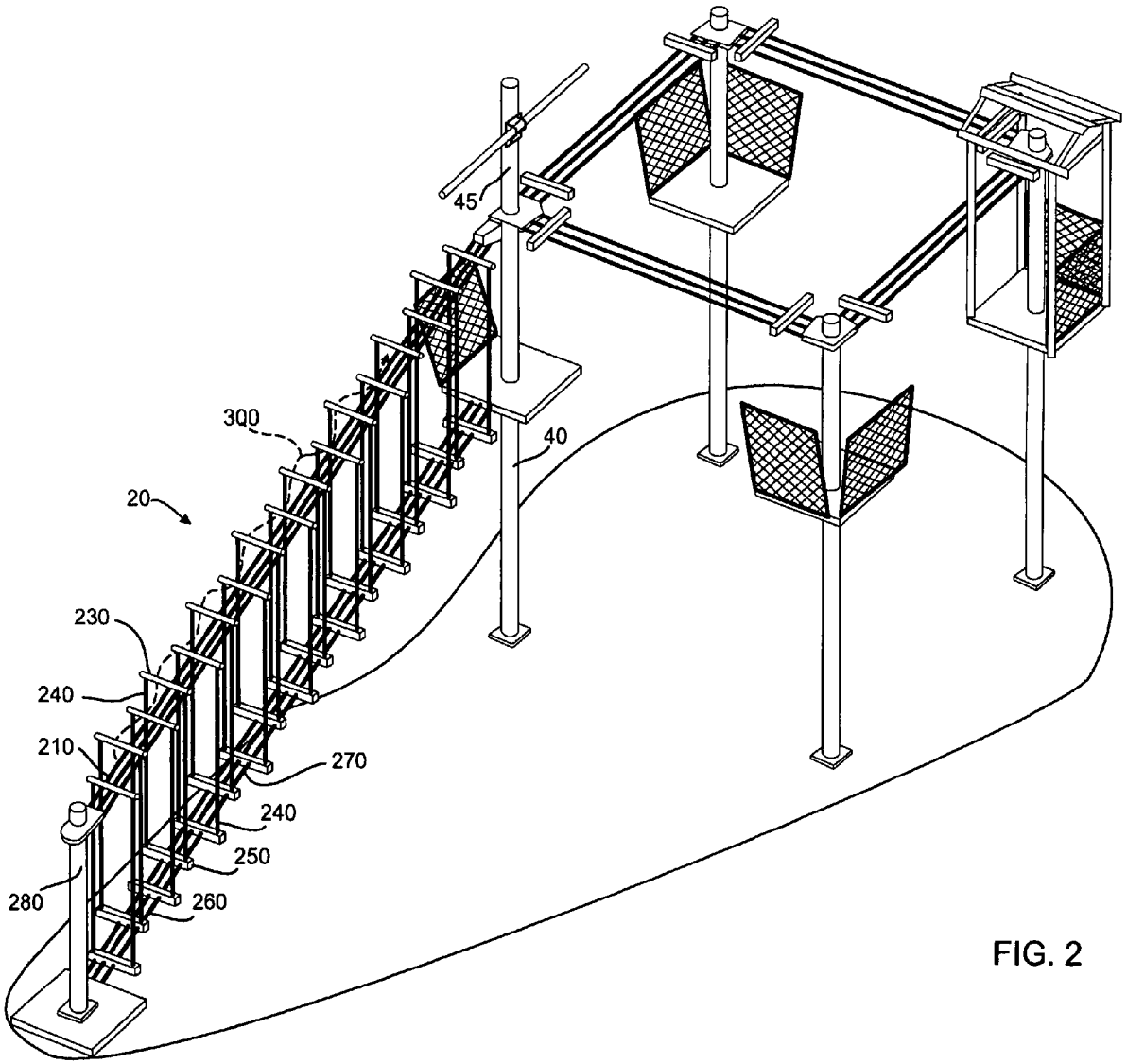
FIG. 2 is a pictorial view of the entrance-exit portion of one embodiment of the present invention.

FIG. 2 illustrates an embodiment of the entrance-exit area 20. An entrance-exit tracking member 210 may be secured to an entrance-exit support structure 280 at one end, and to a support member 40 at the other end. An arm 230 may be secured to the entrance-exit tracking member 210. Multiple arms 230 that have substantially the same size may be secured to the entrance-exit tracking member 210 in such a way as to define a non-linear path 300. The entrance-exit tracking member 210 may be the type as disclosed is U.S. Pat. No. 7,416,054, ("the 054 patent"), issued on 26 Aug. 2008; which is described in the abstract as "[a]n apparatus and method of traversing across elements of a challenge course by use of a tracking system that can continuously retain the harness cable that descends to the participant, as the moveable member moves in a substantially horizontal direction along the safety cables, or along the tracks of the moveable member exchange frame." This will be described in this document as "the tracking system." In other words, the entrance-exit tracking member 210 may be the same as the tracking member 50 or tracking member 80, as shown in FIG. 3.

The arm 230, which may be disposed above the entrance-exit tracking member 210 may have a rope 240 secured thereto. The rope 240 extending downwardly from the arm 230 to connect to a base 250. The base 250 may have a guide aperture 260 or a plurality of guide apertures 260. A guide 270 or a plurality of guides 270 may be disposed through the guide aperture 260. The base 250 have a guide aperture 260 disposed leftwardly, and the next successive base 250 may have a guide aperture 260 disposed rightwardly in alternating fashion, creating a non-linear path 300 (as best seen in FIG. 2) for the user, whereby a user walking up or down the bases 250 is forced to walk leftwardly and rightwardly, in a serpentine direction or fashion along the non-linear path 300. The user may be secured into the tracking system 50, 80, 210 from the ground level, and may proceed around the entire track 50, 80 while secured into the tracking system, as noted One purpose of the non-linear path 300 is to prevent one person who may be ascending or descending to fall into another user, to create a domino effect of people falling. Falling may cause injury, and may slow down the usage opportunities.

In one embodiment, a participant can stand on the base 250, and hang on to a rope 240. And when traversing several bases 250, the participant would walk in a non-linear path 300 while the participant is hooked into the tracking member 50, 80 with an appropriate harness or cable. The base 250 may have a base-aperture 260 to receive a guide 270 therethrough.

Figure 3:
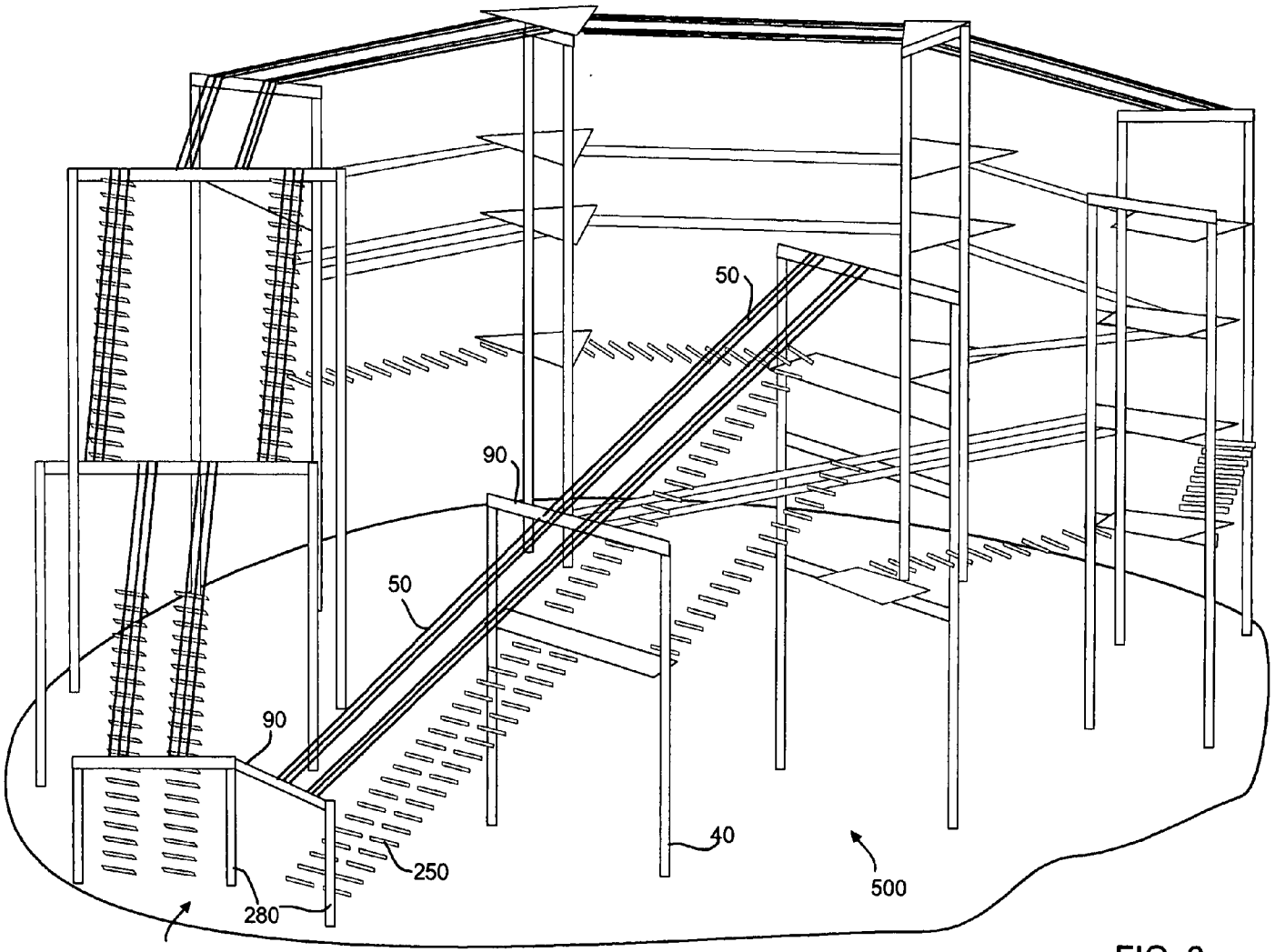
FIG. 3 is a pictorial view of one embodiment of the present invention with a tracking member shown above the guide.
Figure 4:
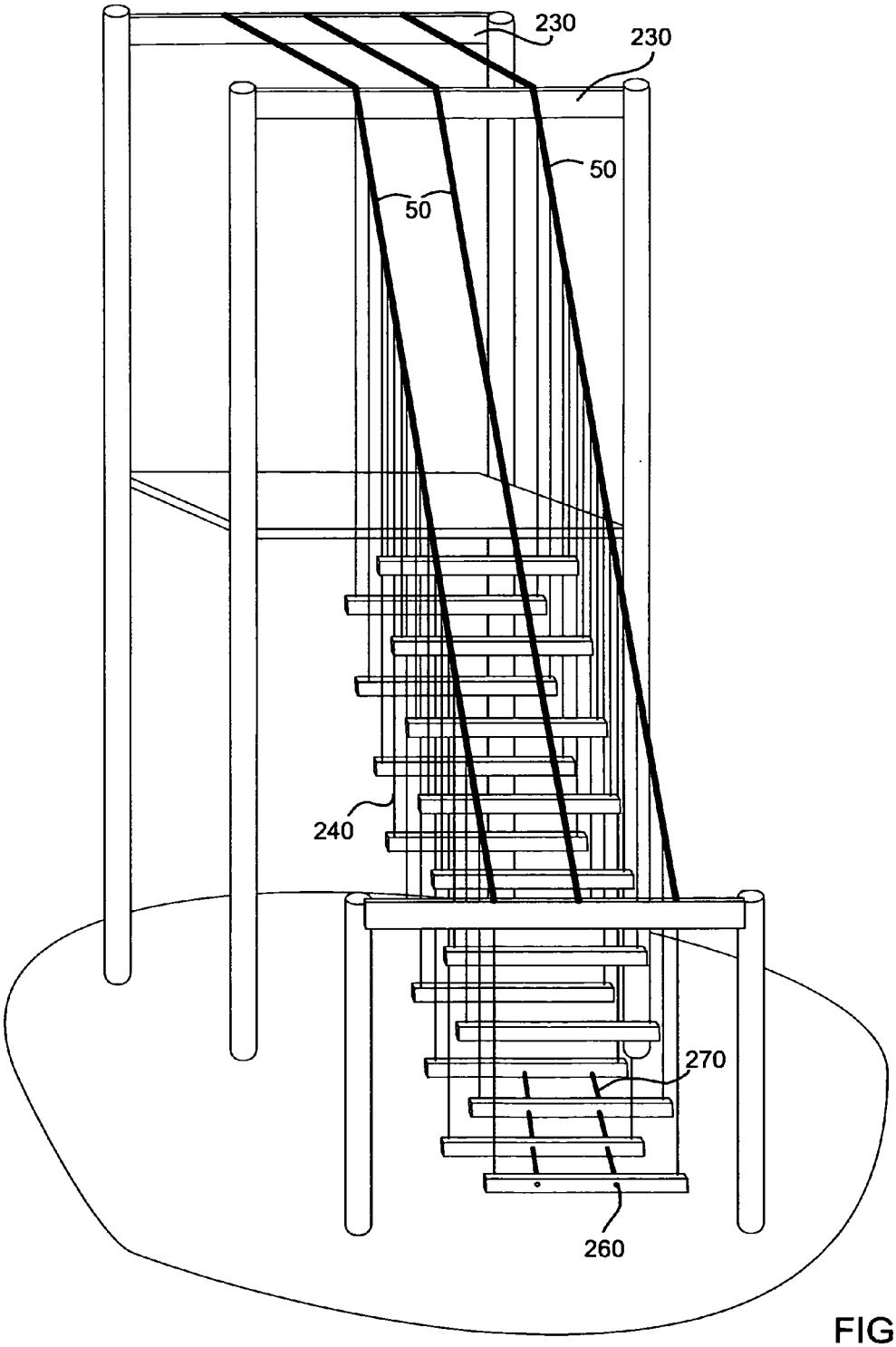
FIG. 4 is a pictorial that illustrates one embodiment of a view of the bars 230 and bases 250 are arranged to create a non-linear path 300.

FIG. 3 illustrates a tracking system 50, 80. However the bases 250 may still be arranged in a serpentine fashion, as described above, as illustrated in FIG. 4.

FIG. 3 illustrates the bar 230 disposed above the tracking member 50, 80. However it may also be secured to tracking member 50, 80 so it does not fall off. It may be secured by brackets, or it may be securably disposed through tracking member 50, 80. The guide 270 is shown going through the guide apertures 260, to retain the bases 250 in an alternating serpentine orientation to create a non-linear path 300.

An entrance-exit support structure 280 may be secured to the ground, and extend upwardly and secured to a vertical member 90. The vertical member 90 may be secured to the tracking member 50, 80. The bases 250 may be secured to the tracking members 50, 80 via ropes 240. The entrance-exit tracking member 210 in FIG. 3 may be the same as tracking members 50, 80.

The tracking member 50 may be substantially parallel to tracking member 80. This way, two lines of people may be using the present invention 10.

As further illustrated in FIG. 3, there may be two successive parallel sets of non-linear paths 300, one set in bay 400, the other in bay 500, before the course tracking members 50, 80 may start to level off. Of course the non-linear path 300 may be disposed anywhere along the course, and the same ascending and descending orientation of the bases 250 and accompanying tracking system 210, 50, 80 may be placed anywhere on the course 10.

It should be understood, of course, that the foregoing relates to exemplary embodiments of the invention and that modifications may be made without departing from the spirit and scope of the invention as set forth in the following claims.

I claim:

1. An elevated adventure course (10), comprising:

an ascending entrance-exit tracking member (210);

a plurality of bases (250) disposed downwardly from said ascending entrance exit tracking member (210), at a substantially consistent distance; said bases (250) oriented leftwardly and rightwardly in alternating fashion to define a non-linear path (300) of the person using the elevated adventure course (10);

a member (240) securing said base (250) to said entrance-exit tracking member (210); and whereby a user walking up or down the bases 250 is forced to walk leftwardly and rightwardly.

2. The apparatus of claim 1, further comprising a tracking member (50) is substantially parallel to a tracking member (80), and both tracking members (50), and (80) are orientated side-by-side, whereby different users can be using both tracking members (50), (80) at the same time; and whereby said entrance-exit tracking member (210), and said tracking member 50 allow the traversing across elements of a challenge course by use of a tracking system.

3. The apparatus of claim 1, wherein said ascending entrance-exit tracking member (210), is be secured between an entrance-exit support structure (280) and a support member (40), to define a first bay (400); and a tracking member (50), (80) is secured between said support member (40) and another support member (40), to define a second bay (500), wherein said second bay (500) is adjacent to said first bay (400).

4. The apparatus of claim 1, further comprising:

an entrance-exit area (20) having an entrance-exit platform (30) connected to a support member (40);

a tracking member (50) secured to a top portion (45) of said support member (40);

an element (60) secured to said support member (40); and a path (100) defined by a plurality of said elements (60) that leads to a second entrance-exit area (22).

5. The apparatus of claim 4, further comprising:

a second tracking member (80) secured to a top portion (45) of said support member (40); said second tracking member (80) disposed substantially parallel with said tracking member (50).

6. The apparatus of claim 1, further comprising:

an entrance-exit area (20) having an entrance-exit support structure (280);

an entrance-exit tracking member (210) secured at one end to said entrance-exit support structure (280), and secured at another end to a support member (40);

a plurality of arms (230) secured to said entrance-exit tracking member (210);

a rope (240) extending downwardly from said arms (230); and a base (250) secured to said rope (240);

whereby the plurality of ropes (240) define a non-linear pathway (300).

7. An elevated adventure course (10), comprising:

an entrance-exit platform (30) connected to a support member (40);

a tracking member (50) secured to a top portion (45) of said support member (40);

an element (60) secured to said support member (40);

a path (100) defined by a plurality of said elements (60);

a second tracking member (80) secured to a top portion (45) of said support member (40); said second tracking member (80) disposed substantially parallel with said tracking member (50);

an entrance-exit area (20) having an entrance-exit support structure (280);

an entrance-exit tracking member (210) secured at one end to said entrance-exit support structure (280), and secured at another end to said support member (40);

a plurality of arms (230) secured to said entrance-exit tracking member (210);

a rope (240) extending downwardly from said arm (230); and a base (250) secured to said rope (240);

whereby the plurality of ropes (240) define a non-linear pathway (300) that leads to a second entrance-exit area (22).

8. A method of traversing along an elevated challenge course comprising the steps of:

traversing relative to an ascending entrance-exit tracking member (210), (50), (80) connected at one end to an entrance-exit support structure 280, and connected at another end to a support member (40);

traversing upon a plurality of bases (250) disposed downwardly from said ascending entrance-exit tracking member (210), (50), (80), said plurality of bases (250) disposed downwardly from said entrance exit tracking member (210), (50), (80) at a substantially consistent distance; said bases (250) oriented leftwardly and rightwardly in alternating fashion to define a non-linear path (300) of the person using the elevated adventure course (10); and traversing along said non-linear path (300).

* * * * *